US007701454B2

(12) United States Patent
Cho et al.

(10) Patent No.: US 7,701,454 B2
(45) Date of Patent: Apr. 20, 2010

(54) FIELD EMISSION DISPLAY APPARATUS

(75) Inventors: Duck-Gu Cho, Suwon-si (KR); Deok-Hyeon Choe, Suwon-si (KR); Chul-Ho Lee, Suwon-si (KR); Mun-Seok Kang, Suwon-si (KR); Ji-Won Lee, Suwon-si (KR); Choon-Sook Kim, Suwon-si (KR); Dong-Hyup Jeon, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 376 days.

(21) Appl. No.: 11/835,987

(22) Filed: Aug. 8, 2007

(65) Prior Publication Data

US 2008/0036357 A1 Feb. 14, 2008

Related U.S. Application Data

(60) Provisional application No. 60/836,782, filed on Aug. 9, 2006.

(30) Foreign Application Priority Data

Mar. 30, 2007 (KR) ..... 10-2007-0031964

(51) Int. Cl.
*G09G 5/00* (2006.01)
*G09G 3/10* (2006.01)

(52) U.S. Cl. ..... 345/212; 345/211; 345/204; 345/77; 345/76; 315/169.3; 315/169.4

(58) Field of Classification Search ..... 345/204, 345/207, 211, 212, 214, 63, 74.1, 75.1, 75.2, 345/76, 77, 82, 83; 315/169.3, 169.4, 169.1, 315/169.2

See application file for complete search history.

(56) References Cited

U.S. PATENT DOCUMENTS 7,274,363 B2 * 9/2007 Ishizuka et al. ..... 345/211
2003/0122118 A1 7/2003 Lee et al.

FOREIGN PATENT DOCUMENTS

JP 8-171366 A 7/1996
KR 1999-0088016 A 12/1999
KR 10-0440540 B1 7/2004

OTHER PUBLICATIONS

Patent Abstracts of Japan for Publication No. 08-171366, published on Jul. 2, 1996 in the name of Kinoshita Fumio.
Korean Patent Abstracts for Publication No. 1019990088016 A, published on Dec. 27, 1999 in the name of Kuno Mitsutoshi et al.
Korean Patent Abstracts for Publication No. 100440540 B1, published on Jul. 6, 2004 in the name of Ko, Seong Hyeon.

* cited by examiner

*Primary Examiner*—Tuyet Vo
(74) *Attorney, Agent, or Firm*—Christie, Parker & Hale, LLP

(57) ABSTRACT

A field emission display apparatus including a field emission display panel and a driving device for the field emission display panel. The driving device includes a power supply unit, the power supply unit including an abnormal current detection unit and a discharge circuit. The abnormal current detection unit generates an arc-current detection signal when the value of a current flowing between a negative anode voltage terminal of the field emission display panel and a common ground line is larger than an upper limit. The discharge circuit generates a short circuit between an anode plate of the field emission display panel and the negative anode voltage terminal when the arc-current detection signal is generated from the abnormal current detection unit.

11 Claims, 10 Drawing Sheets

FIELD EMISSION DISPLAY APPARATUS

CROSS-REFERENCE TO RELATED PATENT APPLICATIONS

This application claims priority to and the benefit of Korean Patent Application No. 10-2007-0031964, filed on Mar. 30, 2007, in the Korean Intellectual Property Office, and U.S. Provisional Patent Application No. 60/836,782, filed on Aug. 9, 2006, in the U.S. Patent and Trademark Office, the entire contents of both of which are incorporated herein by reference.

BACKGROUND OF THE INVENTION

1. Field of the Invention

The present invention relates to a field emission display apparatus, and more particularly, to a field emission display apparatus including a field emission display panel and a driving device for the same.

2. Description of the Related Art

U.S. Patent Publication No. 2003/122,118 (entitled "FED driving method") is an example of conventional art related to field emission display apparatuses.

In such field emission display apparatuses, a field emission display panel typically includes electron emitter sources, data electrode lines, scan electrode lines, fluorescent cells, and an anode plate. The direction of scan electrode lines intersect the direction of data electrode lines. A potential is applied to the anode plate so that electrons from the electron emitter sources can move to the fluorescent cells.

According to the operational characteristics of such field emission display panels, an arc discharge is highly likely to occur between an anode plate and the other electrodes. The arc discharge may be generated due to a reduction in the degree of a vacuum, the insulation destruction caused by, for example, impurities between electrodes, the discharge of electric charges filled in a dielectric, or other factors. When such an arc discharge occurs, electron emitter sources may be damaged or destroyed.

However, conventional field emission display apparatuses have no effective protection circuits to handle an arc discharge.

SUMMARY OF THE INVENTION

In accordance with the present invention a field emission display apparatus is provided having an effective protection circuit capable of coping with an arc discharge.

According to an aspect of the present invention, there is provided a field emission display apparatus including a field emission display panel and a driving device for the field emission display panel. The field emission display panel has a common ground line, fluorescent cells, electron emitter sources and an anode plate, the anode plate being responsive to an anode voltage from a positive anode voltage terminal and a negative anode voltage terminal for emitting electrons from the electron emitter sources to the fluorescent cells. The driving device includes a power supply unit, the power supply unit including an abnormal current detection unit and a discharge circuit.

The abnormal current detection unit generates an arc-current detection signal when the value of a current flowing between the negative anode voltage terminal and a common ground line is larger than a predetermined upper limit.

The discharge circuit generates a short circuit between the anode plate and the negative anode voltage terminal when the arc-current detection signal is generated from the abnormal current detection unit.

As described above, in a field emission display apparatus according to the present invention, generation or non-generation of an arc discharge is determined from the value of a current flowing between the negative anode voltage terminal and a common ground line. Accordingly, the determination is rapidly made because the fact that an anode current flows suddenly when an arc discharge is generated in a field emission display panel was used.

Thus, when an arc discharge is generated in the field emission display panel, an arc-current detection signal may be rapidly generated by an abnormal current detection unit, and an application of the anode voltage by a discharge circuit may be rapidly blocked.

A current monitoring resistor is used to measure the value of the current flowing between the negative anode voltage terminal and the common ground line. Thus, an initial current caused by the arc discharge may be prevented.

A voltage monitoring inductor may be used between the positive anode voltage terminal and the anode plate, such that an abnormal voltage detection unit generates an arc-voltage detection signal when a difference between voltages at both ends of the voltage monitoring inductor is larger than an upper limit.

An OR logic circuit may output an arc generation signal for operating the discharge circuit in response to the arc-current detection signal or in response to the arc-voltage detection signal.

Accordingly, the field emission display apparatus according to the present invention provides an effective protection circuit capable of coping with an arc discharge.

DETAILED DESCRIPTION

Figure 1:
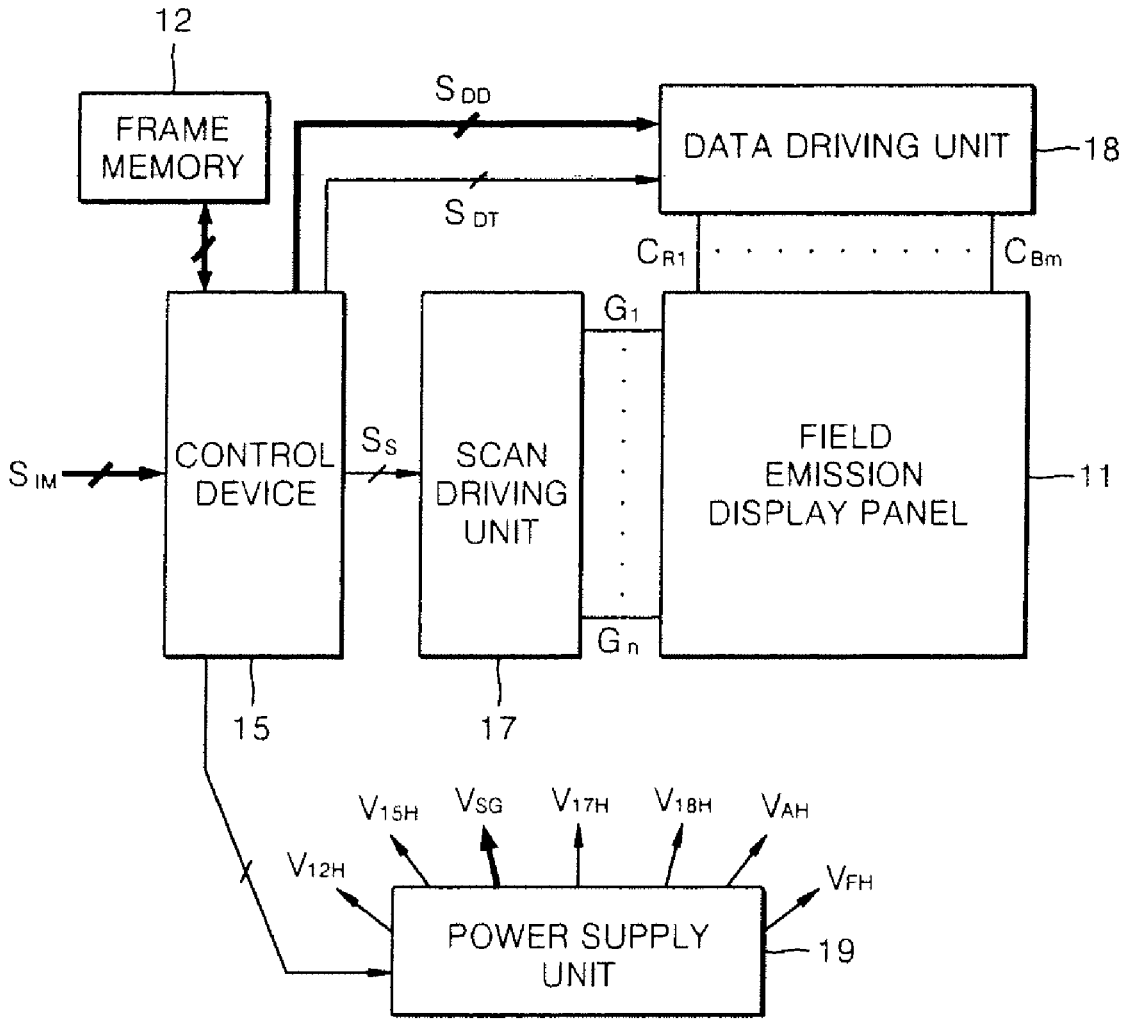
FIG. 1 is a block diagram of a field emission display apparatus according to an embodiment of the present invention.
Figure 3:
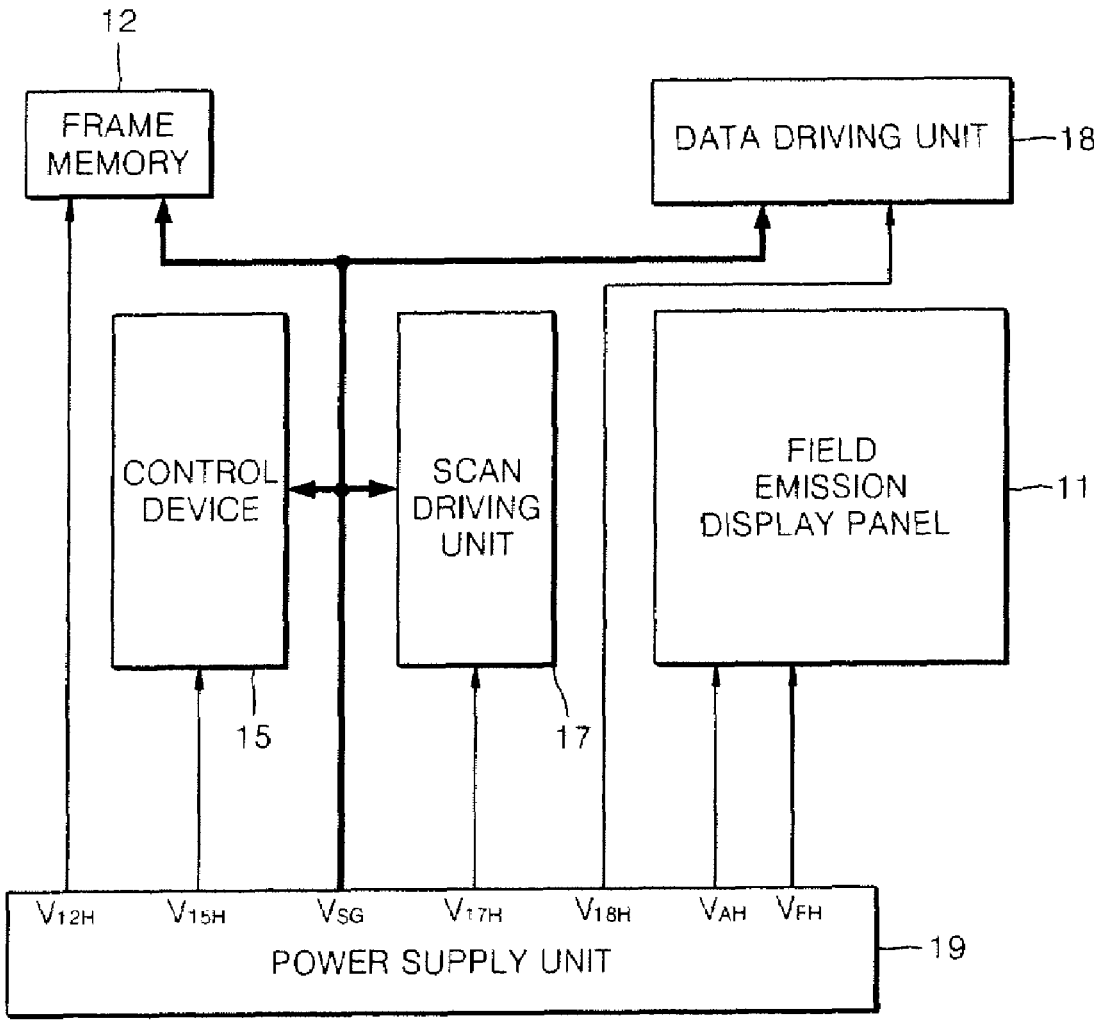
FIG. 3 is a block diagram showing potentials supplied from the power supply unit illustrated in FIG. 1 to each of the other units illustrated in FIG. 1.

Referring to FIGS. 1 and 3, the field emission display apparatus according to an embodiment of the present invention includes a field emission display panel 11 and a driving device for the field emission display panel 11. The driving device includes a power supply unit 19, a scan driving unit 17, a data driving unit 18, a frame memory 12, and a control device 15.

The power supply unit 19 applies a system ground potential $V_{SG}$ and an operational potential $V_{12H}$ to the frame memory 12, the system ground potential $V_{SG}$ and an operational potential $V_{15H}$ to the control device 15, the system ground potential $V_{SG}$ and an operational potential $V_{17H}$ to the scan driving unit 17, an operational potential $V_{18H}$ and the system ground potential $V_{SG}$ to the data driving unit 18, an anode potential $V_{AH}$ to an anode plate 22 (shown in FIG. 2) included in the field emission display panel 11, and a focusing potential $V_{FH}$ to a focusing electrode plate 36 (shown in FIG. 2) included in the field emission display panel 11.

The scan driving unit 17 drives gate electrode lines $G_1$ through $G_n$, which are scan electrode lines of the field emission display panel 11. The data driving unit 18 drives cathode electrode lines $C_{R1}$ through $C_{Bm}$, which are data electrode lines of the field emission display panel 11. The frame memory 12 temporarily stores digital image data.

The control device 15 is formed of a monolithic integrated circuit device, for example, a field-programmable gate array (FPGA), and performs a variety of functions. The control device 15 converts input image signals $S_{IM}$ into digital image data, temporarily stores the digital image data in the frame memory 12, and pulse width modulation (PWM) data and timing control signals which are used for gray scale display. The control device 15 also provides PWM data $S_{DD}$ and timing control signals $S_{DT}$ to the data driving unit 18 and provides timing control signals $S_S$ to the scan driving unit 17.

Figure 2:
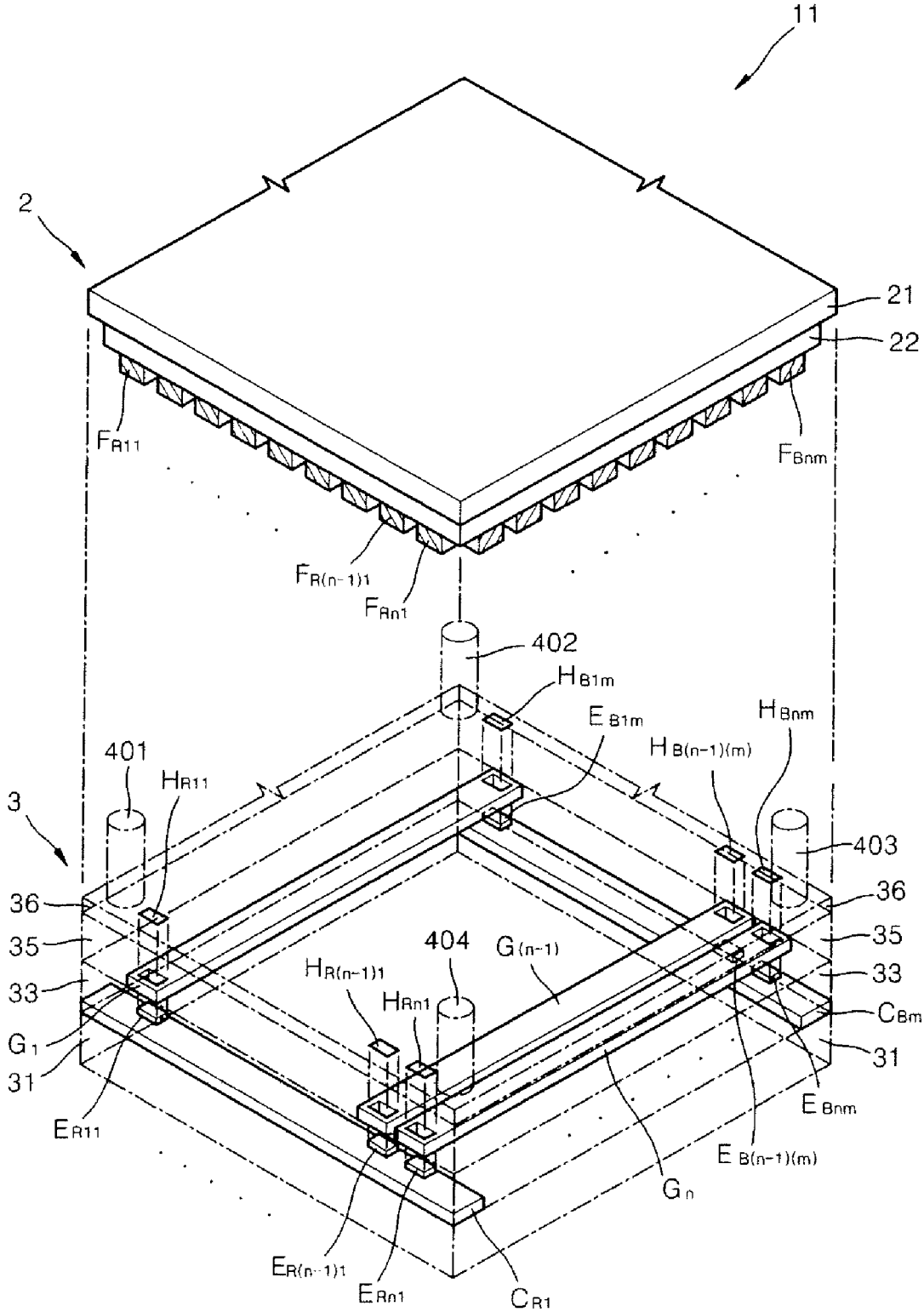
FIG. 2 is an exploded perspective view of the field emission display panel illustrated in FIG. 1.

Referring now to FIG. 2, the field emission display panel 11 illustrated in FIG. 1 includes a front panel 2 and a rear panel 3 which are supported by exterior space bars 401, 402, 403, 404. A plurality of additional interior space bars (not shown) are also situated on the focusing electrode plate 36.

The rear panel 3 includes a rear substrate 31, cathode electrode lines $C_{R1}$ through $C_{Bm}$, electron emitter sources $E_{R11}$ through $E_{Bnm}$, a first insulation layer 33, gate electrode lines $G_1$ through $G_n$, a second insulation layer 35, and the focusing electrode plate 36.

The cathode electrode lines $C_{R1}$ through $C_{Bm}$, to which data signals are applied, are electrically connected to the electron emitter sources $E_{R11}$ through $E_{Bnm}$. The first insulation layer 33, the gate electrode lines $G_1$ through $G_n$, the second insulation layer 35, and the focusing electrode plate 36 have through-holes $H_{R11}$ through $H_{Bnm}$ respectively corresponding to the electron emitter sources $E_{R11}$ through $E_{Bnm}$. Accordingly, the gate electrode lines $G_1$ through $G_n$ have the through-holes $H_{R11}$ through $H_{Bnm}$ in their areas that are overlapped by the cathode electrode lines $C_{R1}$ through $C_{Bm}$. The focusing potential $V_{FH}$ (shown in FIG. 4) is applied to the focusing electrode plate 36.

The front panel 2 includes a front transparent substrate 21, an anode plate 22, and fluorescent cells $F_{R11}$ through $F_{Bnm}$. The fluorescent cells $F_{R11}$ through $F_{Bnm}$ respectively correspond to the through-holes $H_{R11}$ through $H_{Bnm}$, of the focusing electrode plate 36. A high positive potential $V_{AF}$ (shown in FIG. 4) of 1-4 KV is applied to the anode plate 22 so that electrons from the electron emitter sources $E_{R11}$ through $E_{Bnm}$ can move to fluorescent cells.

Figure 4:
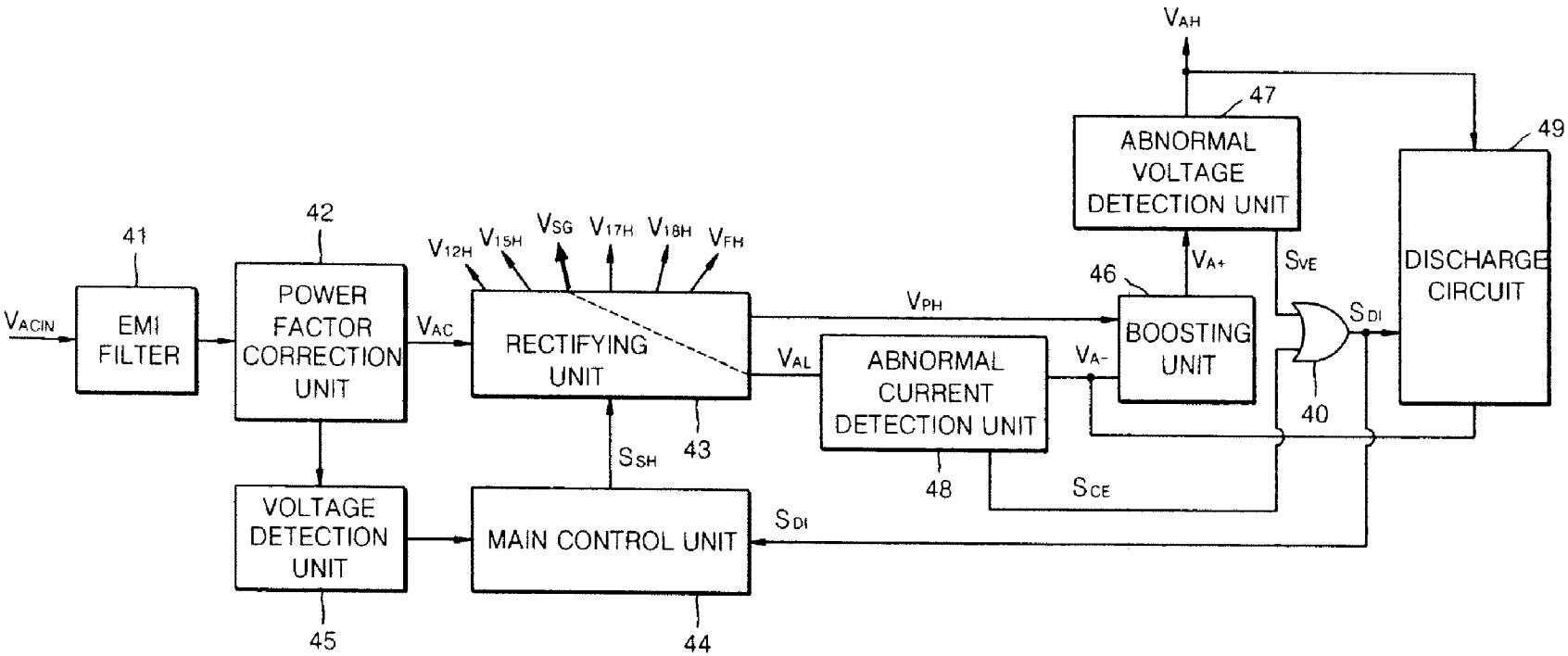
FIG. 4 is a block diagram of the power supply unit illustrated in FIG. 1.

FIG. 4 is a block diagram of the power supply unit 19 illustrated in FIG. 1. Referring to FIG. 4, the power supply unit 19 includes an electromagnetic interference (EMI) filter 41, a power factor correction unit 42, a rectifying unit 43, a main control unit 44, a voltage detection unit 45, a boosting unit 46, an abnormal current detection unit 48, a discharge circuit 49, an abnormal voltage detection unit 47, and an OR logic circuit 40.

The EMI filter 41 filters out EMI noise from a power voltage $V_{ACIN}$, for example, a 220V alternating current (AC) voltage. The power factor correction unit 42 reduces power consumption by correcting the power factor of input AC power. The rectifying unit 43 rectifies an AC voltage $V_{AC}$ received from the power factor correction unit 42 and simultaneously generates power voltages $V_{12H}$ through $V_{PH}$ required by the units included in the field emission display apparatus illustrated in FIG. 1. The boosting unit 46 boosts a first voltage $V_{PH}$ from the rectifying unit 43 to generate an anode voltage $V_{A+}$.

The voltage detection unit 45 detects a voltage input to the power factor correction unit 42 and inputs a result of the detection to the main control unit 44.

The main control unit 44 generates a signal $S_{SH}$ for controlling the operation of the rectifying unit 43, according to a detection voltage from the voltage detection unit 45 and an arc generation signal $S_{DI}$ from the OR logic circuit 40.

The abnormal current detection unit 48 generates an arc-current detection signal $S_{CE}$ when a current flowing between a negative terminal $V_{A-}$ of an anode voltage $V_{AH}$ of the field emission display panel 11 illustrated in FIG. 1 and a common ground line $V_{AL}$ is greater than a predetermined upper limit. In this case, the arc generation signal $S_{DI}$ is generated by the OR logic circuit 40, and thus the discharge circuit 49 is driven by the arc generation signal $S_{DI}$. Accordingly, the discharge circuit 49 generates a short-circuit between the anode plate 22 (shown in FIG. 2) of the field emission display panel 11 and the negative terminal $V_{A-}$ of the anode voltage $V_{AH}$. Internal structures of the abnormal current detection unit 48, the OR logic circuit 40, and the discharge circuit 49 will be described in greater detail later with reference to FIGS. 8, 10, and 11.

As described above, generation or non-generation of an arc discharge is determined from the value of current flowing between the negative terminal $V_{A-}$ of the anode voltage $V_{AH}$ and the common ground line $V_{AL}$. Accordingly, the determination is rapidly made because the fact that an anode current flows suddenly when an arc discharge is generated in a field emission display panel was used.

Thus, when an arc discharge is generated in the field emission display panel 11 illustrated in FIG. 1, the arc-current detection signal $S_{CE}$ may be rapidly generated by the abnormal current detection unit 48, and an application of the anode voltage may be rapidly blocked by the discharge circuit 49.

Figure 8:
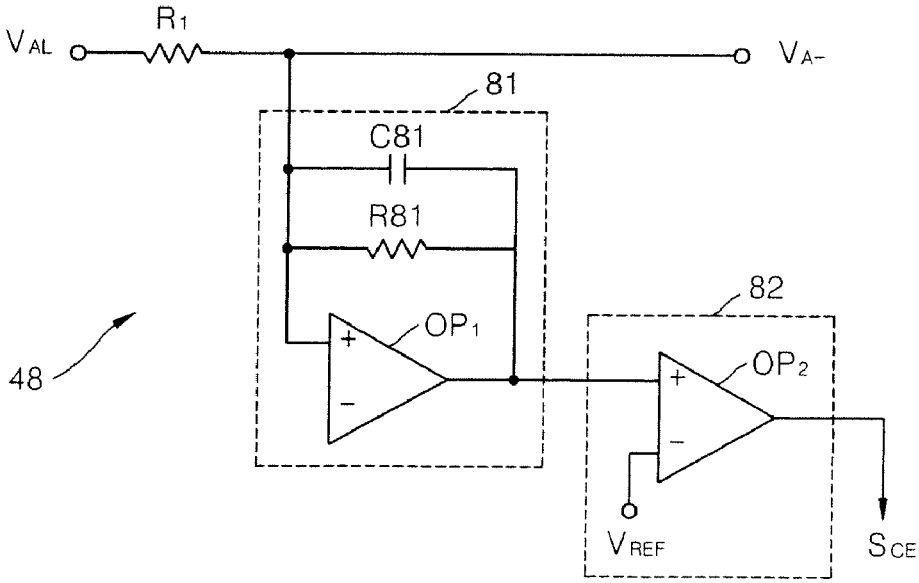
FIG. 8 is a circuit diagram of the abnormal current detection unit illustrated in FIG. 4.

Referring to FIG. 8, a resistor $R_1$ is used to measure the value of the current flowing between the negative terminal $V_{A-}$ of the anode voltage $V_{AH}$ and the common ground line $V_{AL}$. Thus, an initial current caused by the arc discharge may be prevented.

Accordingly, it may be possible to include an effective protection circuit capable of coping with an arc discharge.

Furthermore, in the abnormal voltage detection unit 47, an inductor $I_1$ (shown in FIG. 9) is connected between the positive terminal $V_{A+}$ of the anode voltage of the field emission display panel 11 and the anode plate 22 (shown in FIG. 2) of the field emission display panel 11. The abnormal voltage detection unit 47 generates an arc-voltage detection signal $S_{VE}$ when a difference between the voltages of both ends of the inductor $I_1$ is greater than a predetermined upper limit.

Thus, the protection circuit capable of coping with an arc discharge can be reinforced. In other words, when the potential of the anode plate 22 (shown in FIG. 2) of the field emission display panel 11 is suddenly lowered due to an arc discharge, the potential of the positive terminal $V_{A+}$ of the anode voltage is prevented from suddenly decreasing by the action of the inductor $I_1$. Therefore, the internal circuitry of the power supply unit 19 can be protected.

The abnormal voltage detection unit 47 will be described in greater detail with reference to FIG. 9.

When the arc-current detection signal $S_{CE}$ is generated from the abnormal current detection unit 48 or the arc-voltage detection signal $S_{VE}$ is generated from the abnormal voltage detection unit 47, the OR logic circuit 40 outputs the arc generation signal $S_{DI}$ to operate the discharge circuit 49.

Figure 5:
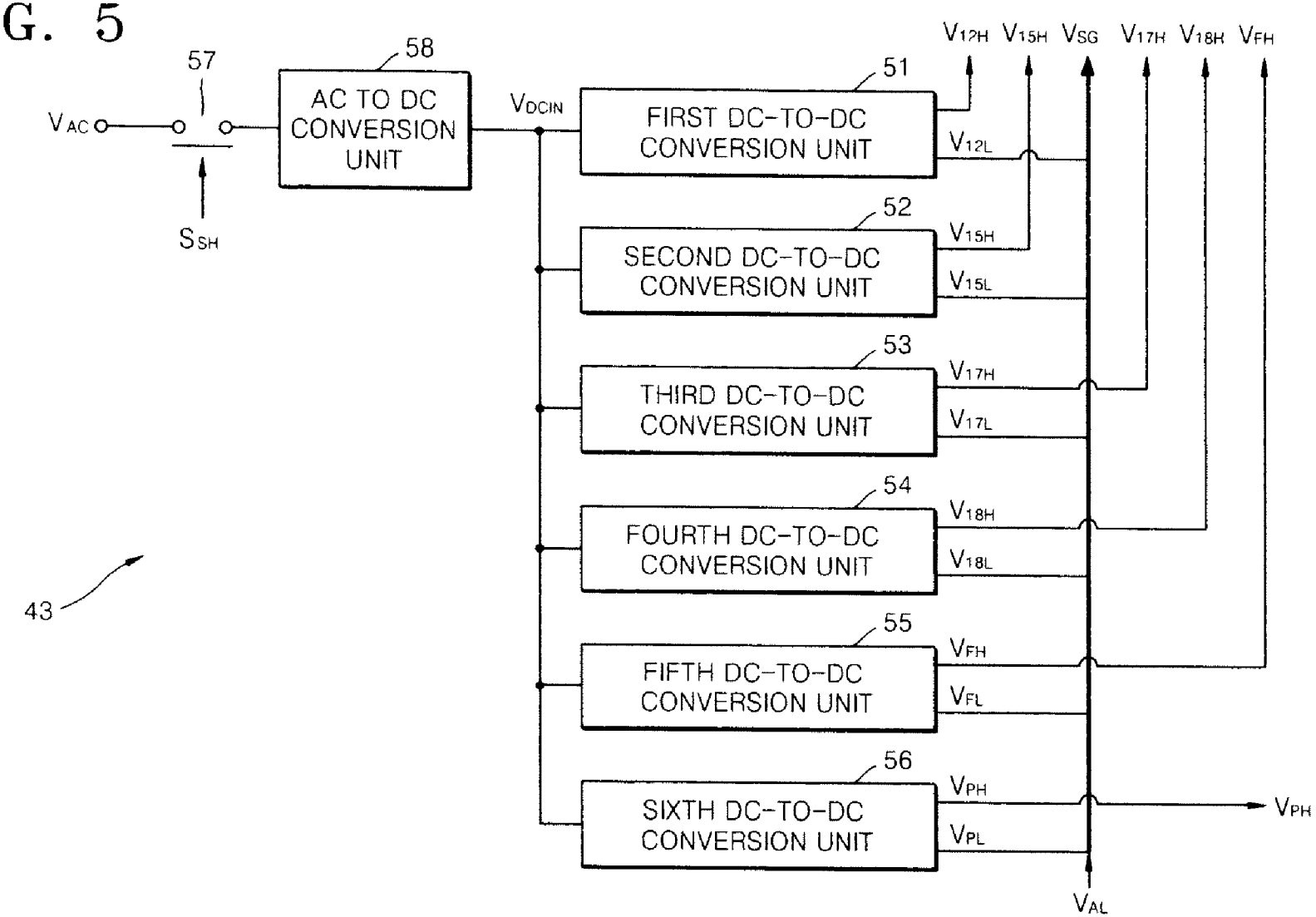
FIG. 5 is a block diagram of the rectifying unit illustrated in FIG. 4.

FIG. 5 is a block diagram of the rectifying unit 43 illustrated in FIG. 4. In FIG. 5, the same reference characters as those illustrated in FIG. 4 denote the same elements.

Referring to FIGS. 4 and 5, the rectifying unit 43 includes a relay 57, an alternating-current to direct-current (AC-to-DC) conversion unit 58, and first through sixth DC-to-DC conversion units 51 through 56.

The relay 57 passes or blocks the AC power $V_{AC}$ under the control of the main control unit 44. The AC-to-DC conversion unit 58 converts the input AC potential into a DC potential $V_{DCIN}$.

Each of the first through sixth DC-to-DC conversion units 51, 52, 53, 54, 55, 56 converts the DC potential $V_{DCIN}$ from the AC to DC conversion unit 58 so as to generate a system ground potential $V_{SG}$, a first potential $V_{PH}$, and operational potentials $V_{12H}$, $V_{15H}$, $V_{17H}$, $V_{18H}$, $V_{FH}$. As described above, the first potential $V_{PH}$ is applied to the boosting unit 46.

Figure 6:
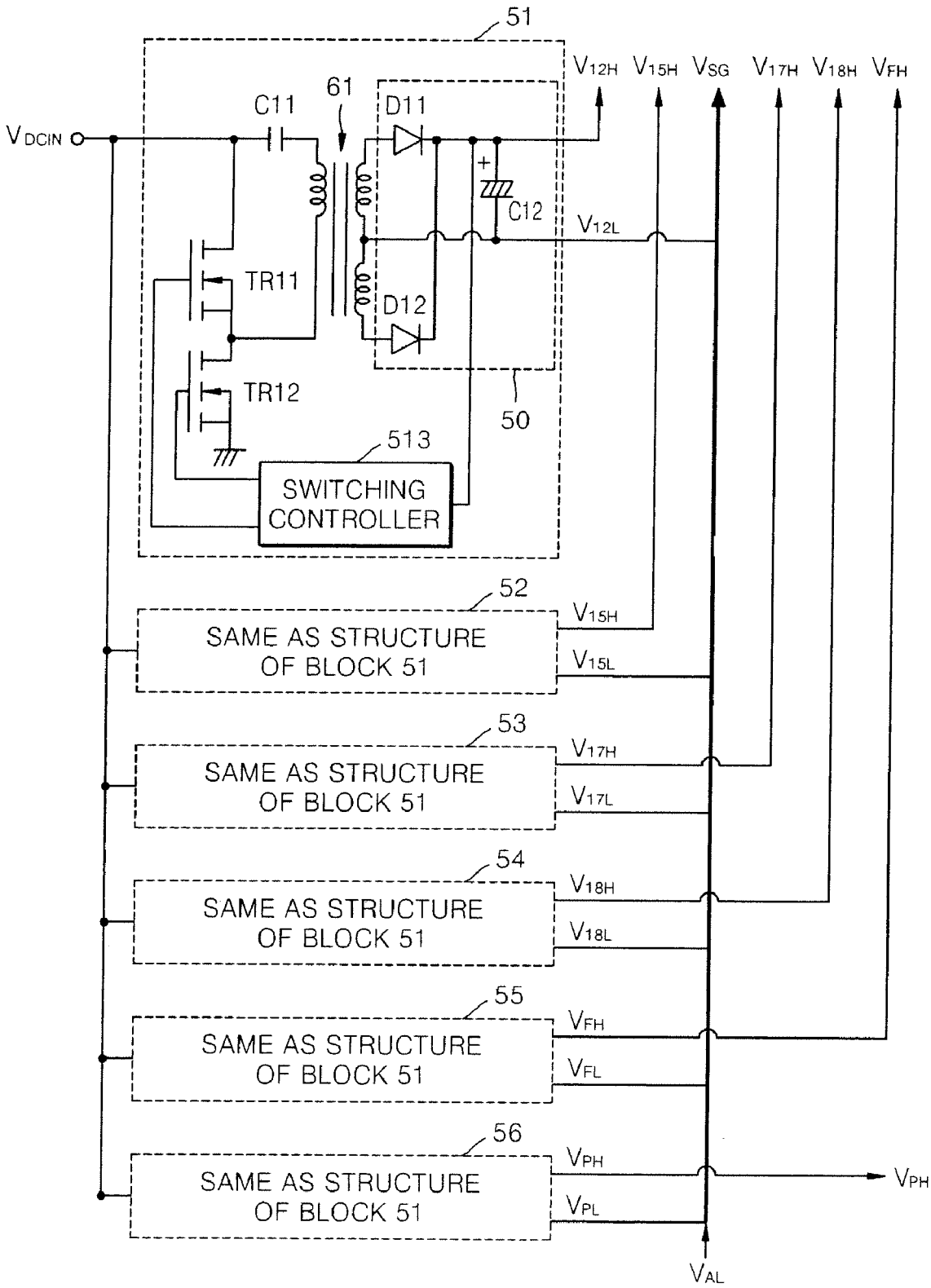
FIG. 6 is a circuit diagram showing the direct-current to direct-current (DC to DC) conversion units illustrated in FIG. 5.

FIG. 6 is a circuit diagram showing the internal circuitry of the DC to DC conversion units 51 through 56 illustrated in FIG. 5. In FIG. 6, the same reference characters as those illustrated in FIGS. 4 and 5 denote the same elements.

Referring to FIGS. 4 through 6, each of the DC-to-DC conversion units 51, 52, 53, 54, 55, 56 includes switching devices TR11, TR12, an AC generation capacitor C11, a transformer 61, a rectifying unit 50 which includes diodes D11, D12 and polarized capacitor C12, and a switching controller 513.

The AC generation capacitor C11 and the switching devices TR11, TR12 switch the DC potential $V_{DCIN}$ of the AC to DC conversion unit 58 so as to generate an AC potential. Accordingly, the transformer 61 transforms the AC voltage generated by the switching devices TR11, TR12.

The rectifying unit 50 converts the AC voltage transformed by the transformer 61 into a DC voltage with a driving potential.

The switching controller 513 periodically turns on and off the switching devices TR11, TR12 and controls the turned-on durations of the switching devices TR11, TR12 so that the output voltage of the switching devices TR11, TR12 is inversely proportional to that of the rectifying unit 50. Therefore, the output voltage of the rectifying unit 50 can be kept constant.

Figure 7:
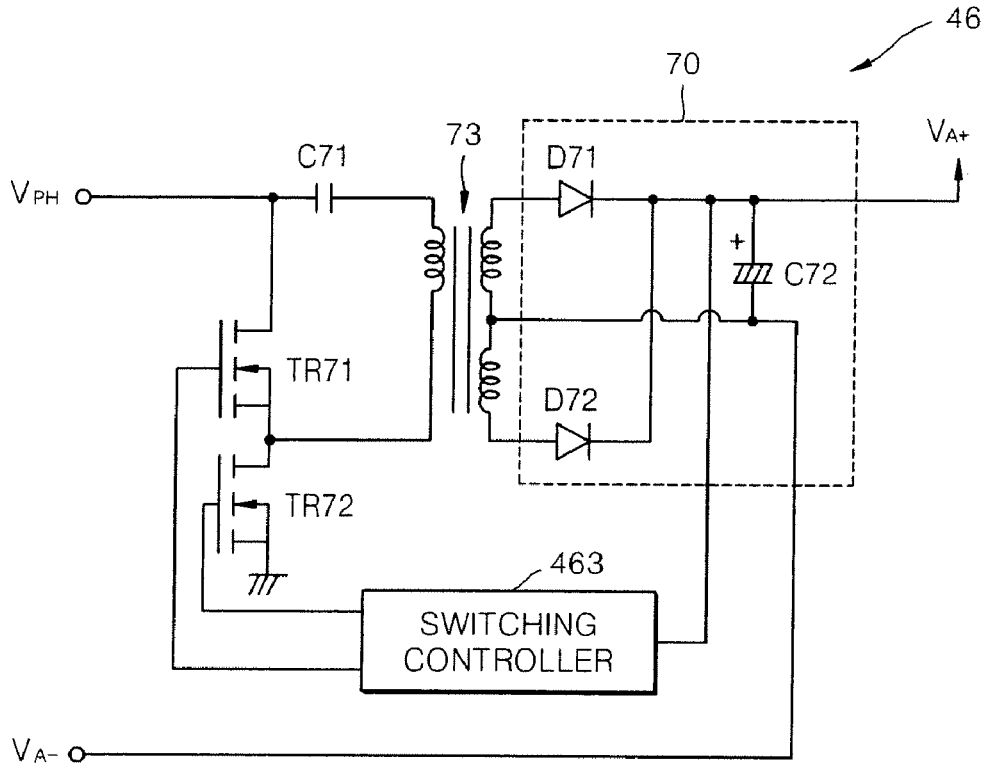
FIG. 7 is a block diagram of the boosting unit illustrated in FIG. 4.

FIG. 7 is a block diagram of the boosting unit 46 illustrated in FIG. 4. In FIG. 7, the same reference characters as those illustrated in FIGS. 4 and 5 denote the same elements.

Referring to FIGS. 4, 5, and 7, the boosting unit 46 includes switching devices TR71, TR72, an AC generation capacitor C71, a transformer 73, a rectifying unit 70, which includes diodes D71, D72 and polarized capacitor C72, and a switching controller 463.

The AC generation capacitor C71 and the switching devices TR71, TR72 switch the first AC voltage $V_{PH}$ of the rectifying unit 43 so as to generate an AC voltage. Accordingly, the transformer 73 transforms the AC voltage generated by the switching devices TR71, TR72.

The rectifying unit 70 converts the AC voltage transformed by the transformer 73 into an anode voltage (that is, a difference between potentials of the positive and negative terminals $V_{A+}$ and $V_{A-}$) that is a DC voltage.

The switching controller 463 periodically turns on and off the switching devices TR71, TR72 and controls the turned-on durations of the switching devices TR71, TR72 so that the output voltage of the switching devices TR71, TR72 is inversely proportional to the anode voltage (that is, the difference between potentials of the positive and negative terminals $V_{A+}$ and $V_{A-}$) output from the rectifying unit 70. Therefore, the anode voltage output from the rectifying unit 70 can be kept constant.

Figure 12:
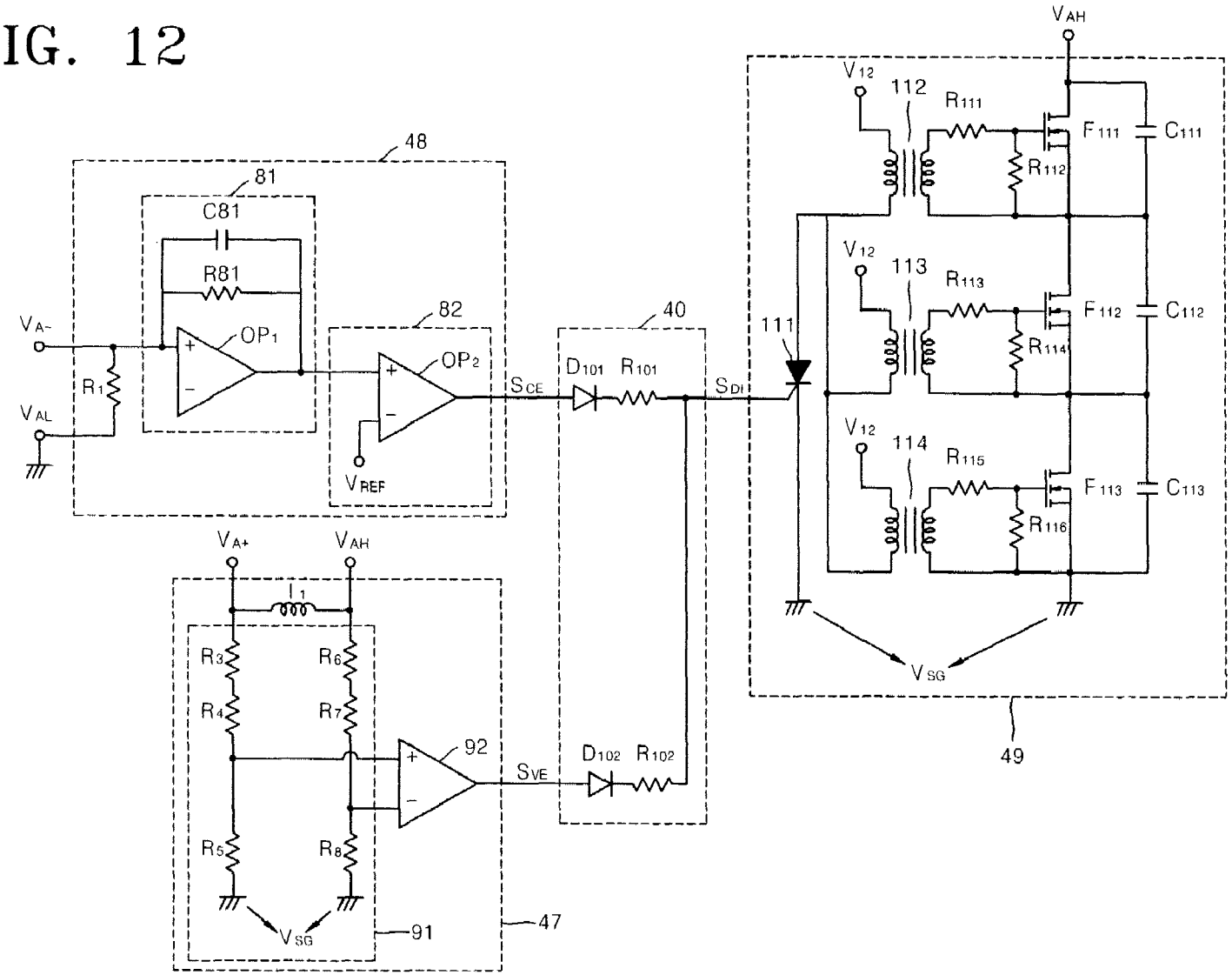
FIG. 12 illustrates a connection of the circuits illustrated in FIGS. 8 and 9.

FIG. 8 is a circuit diagram of the abnormal current detection unit 48 illustrated in FIG. 4. In FIG. 7, the same reference characters as those illustrated in FIG. 4 denote the same elements. FIG. 12 illustrates a connection of the circuits illustrated in FIGS. 8 and 9. Referring to FIGS. 4, 5, 8, and 12, the abnormal current detection unit 48 includes the first resistor $R_1$, an amplification unit 81, and a comparator 82.

The first resistor $R_1$ is connected between the negative terminal $V_{A-}$ of the anode voltage of the field emission display panel 11 and the common ground line $V_{AL}$.

The amplification unit 81 includes a first operational amplifier $OP_1$, resistor R81 and capacitor C81 and amplifies a voltage dropped across the first resistor $R_1$.

The comparator 82 includes a second operational amplifier $OP_2$ and generates the arc-current detection signal $S_{CE}$ when the output voltage of the amplification unit 81 is greater than a predetermined reference voltage $V_{REF}$.

Accordingly, the abnormal current detection unit 48 generates the arc-current detection signal $S_{CE}$ when the value of the current flowing between the negative terminal $V_{A-}$ of the anode voltage (i.e., a difference between potentials of the positive and negative terminals $V_{A+}$, $V_{A-}$) of the field emission display panel 11 and the common ground line $V_{AL}$ is greater than the predetermined upper limit.

As described above with reference to FIG. 4, generation or non-generation of an arc discharge is determined from the value of the current flowing between the negative terminal $V_{A-}$ of the anode voltage $V_{AH}$ of the field emission display panel 11 and the common ground line $V_{AL}$. Accordingly, the determination is rapidly made because the fact that an anode current flows suddenly when an arc discharge is generated in a field emission display panel was used.

Thus, when an arc discharge is generated in the field emission display panel 11 illustrated in FIG. 1, the arc-current detection signal $S_{CE}$ may be rapidly generated by the abnormal current detection unit 48, and an application of the anode voltage may be rapidly blocked by the discharge circuit 49.

The resistor $R_1$ (shown in FIG. 8) is used to measure the value of the current flowing between the negative terminal $V_{A-}$ of the anode voltage $V_{AH}$ and the common ground line $V_{AL}$. Thus, an initial current caused by the arc discharge may be prevented.

Accordingly, it may be possible to include an effective protection circuit capable of coping with an arc discharge.

Figure 9:
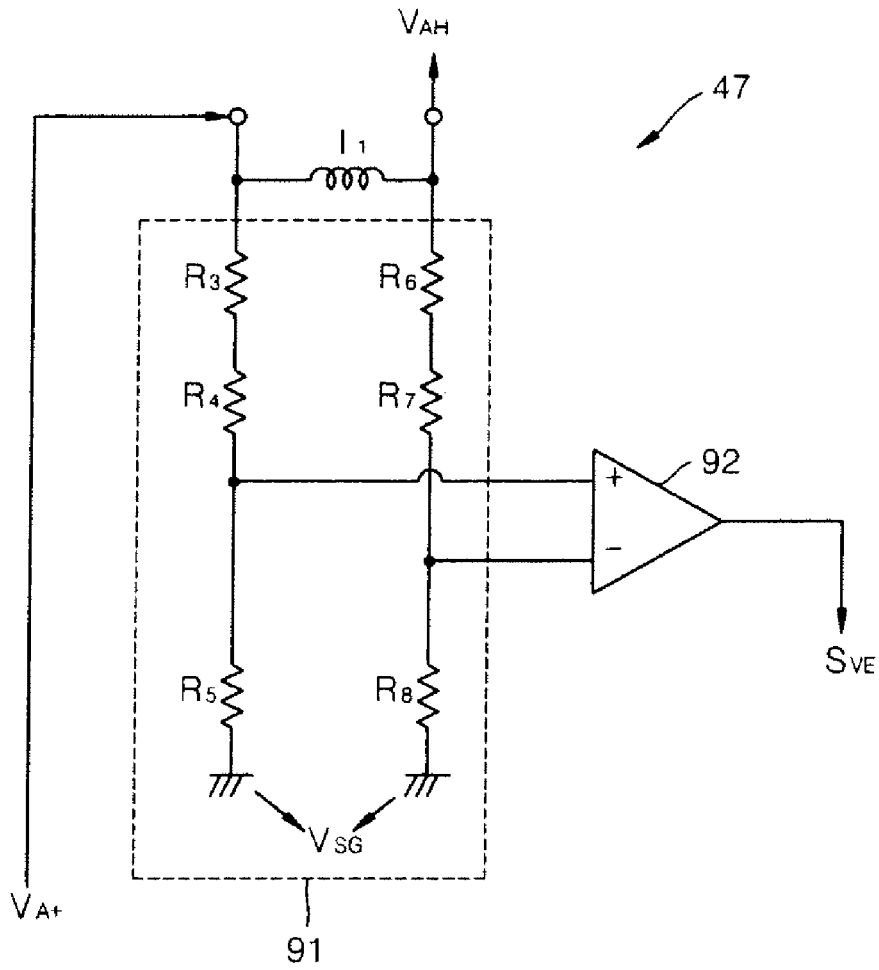
FIG. 9 is a circuit diagram of the abnormal voltage detection unit illustrated in FIG. 4.

FIG. 9 is a circuit diagram of the abnormal voltage detection unit 47 illustrated in FIG. 4. In FIG. 9, the same reference characters as those illustrated in FIG. 4 denote the same elements. Referring to FIGS. 4, 9, and 12, the abnormal voltage detection unit 47 includes the inductor $I_1$, a both-end voltage detection unit 91, and a comparator 92.

As described above with reference to FIG. 9, the inductor $I_1$ is connected between the positive terminal $V_{A+}$ of the anode voltage of the field emission display panel 11 and the anode plate 22 (shown in FIG. 2) of the field emission display panel 11.

The both-end voltage detection unit 91 detects the voltage $V_{A+}$ of the positive terminal of the anode voltage of the field emission display panel by using resistors $R_3$, $R_4$, $R_5$ and detects the voltage $V_{AH}$ of the anode plate of the field emission display panel.

The comparator 92 generates the arc-voltage detection signal $S_{VE}$ when a difference between the two voltages (i.e., $V_{A+}-V_{AH}$) of the voltage detection unit 91 is larger than the predetermined upper limit. When an arc discharge occurs, the difference (i.e., $V_{A+}-V_{AH}$) increases as the voltage $V_{AH}$ of the anode plate of the field emission display panel drops.

Accordingly, the abnormal voltage detection unit 47 generates an arc-voltage detection signal $S_{VE}$ when a difference between the voltages of both ends of the inductor $I_1$ is greater than a predetermined upper limit.

As described above with reference to FIG. 4, the protection circuit capable of coping with an arc discharge can be reinforced due to the abnormal voltage detection unit 47. In other words, when the potential of the anode plate 22 (shown in FIG. 2) of the field emission display panel 11 is suddenly lowered due to an arc discharge, the potential of the positive terminal $V_{A+}$ of the anode voltage is prevented from suddenly decreasing by the action of the inductor $I_1$. Therefore, the internal circuitry of the power supply unit 19 can be protected.

Figure 10:
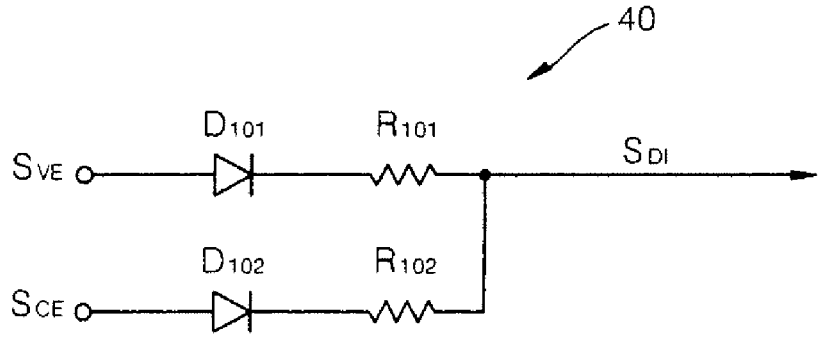
FIG. 10 is a circuit diagram of the OR logic circuit illustrated in FIG. 4.

FIG. 10 is a circuit diagram of the OR logic circuit 40 illustrated in FIG. 4. In FIG. 10, the same reference characters as those illustrated in FIG. 4 denote the same elements. Referring to FIGS. 4, 10, and 12, the OR logic circuit 40 includes diodes $D_{101}$, $D_{102}$ for preventing the current flowing in reverse, and signal-level control resistors $R_{101}$, $R_{102}$.

Accordingly, the OR logic circuit 40 outputs the arc generation signal $S_{DI}$ to operate the discharge circuit 49 when the arc-current detection signal $S_{CE}$ is generated from the abnormal current detection unit 48 or the arc-voltage detection signal $S_{VE}$ is generated from the abnormal voltage detection unit 47.

Figure 11:
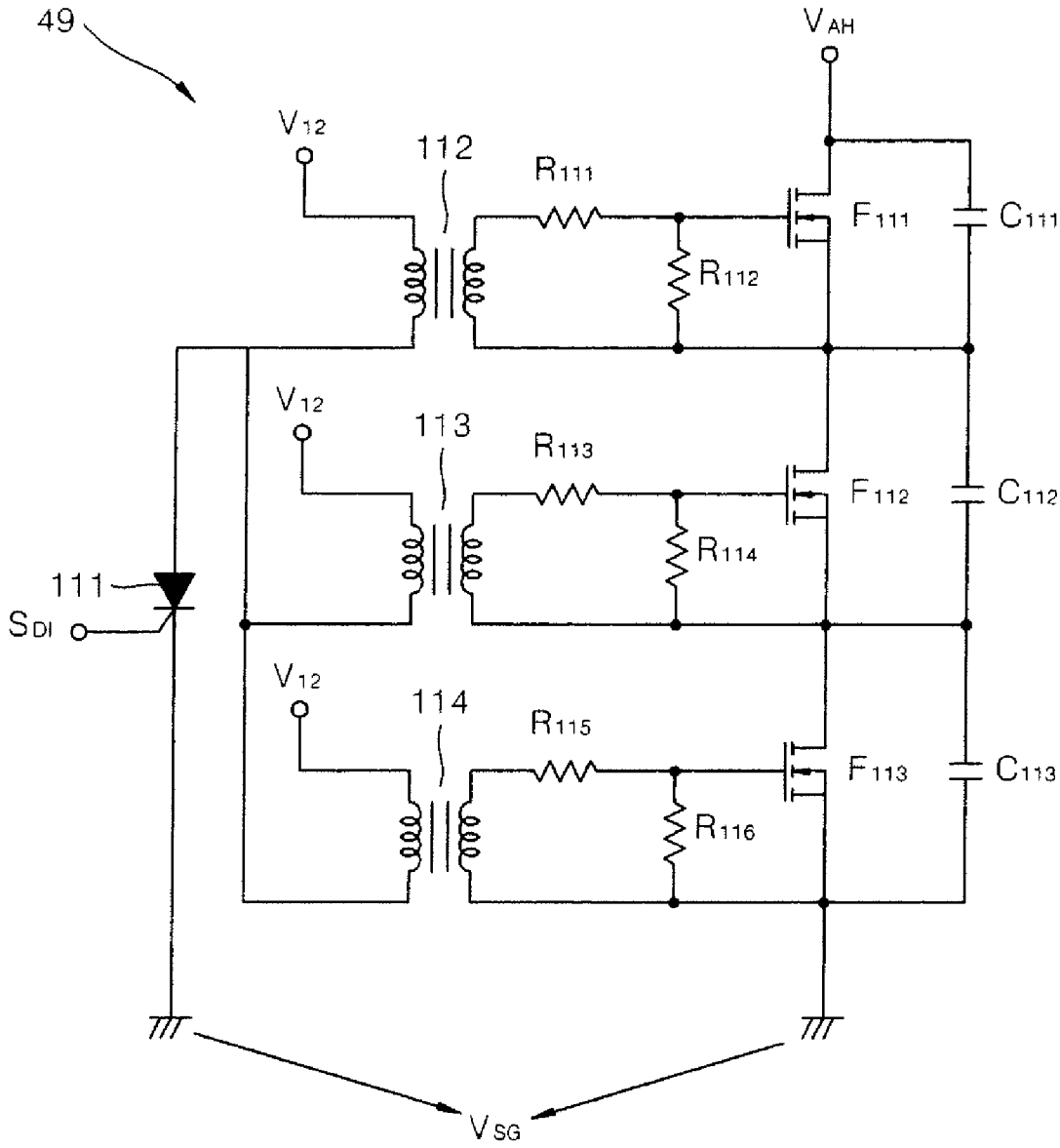
FIG. 11 is a circuit diagram of the discharge circuit illustrated in FIG. 4.

FIG. 11 is a circuit diagram of the discharge circuit 49 illustrated in FIG. 4. In FIG. 11, the same reference characters as those illustrated in FIG. 4 denote the same elements, and reference character $V_{12}$ denotes a 12 V DC supply potential. Referring to FIGS. 4, 11, and 12, the discharge circuit 49 includes a silicon control rectifier 111, first through third transformers 112, 113, 114, resistors $R_{111}$, $R_{112}$, $R_{113}$, $R_{114}$, $R_{115}$ $R_{116}$, first through third field effect transistors (FETs) $F_{111}$, $F_{112}$, $F_{113}$, and first through third capacitors $C_{111}$, $C_{112}$ $C_{113}$.

The silicon control rectifier 111 is turned on when the arc-voltage detection signal $S_{VE}$ is generated from the OR logic circuit 40.

In each of the first through third transformers 112, 113, 114, as the silicon control rectifier 111 is turned on, a current flows in a first coil and a voltage is induced across a second coil.

The resistors $R_{111}$, $R_{112}$, $R_{113}$, $R_{114}$, $R_{115}$ $R_{116}$, are used to control the levels of a current and a voltage.

The first through third field effect transistors $F_{111}$, $F_{112}$, $F_{113}$ are serially connected between the anode plate (i.e., the potential of $V_{AH}$) of the field emission display panel and a system ground potential end (i.e., the potential of $V_{SG}$). At both ends of the second coil of each of the first through third transformers 112 through 114 corresponding to the first through third field effect transistors $F_{111}$, $F_{112}$, $F_{113}$, gates and sources of the first through third field effect transistors $F_{111}$, $F_{112}$, $F_{113}$ are connected to each other via the resistors $R_{111}$, $R_{112}$, $R_{113}$, $R_{114}$, $R_{115}$ $R_{116}$.

The first through third field effect transistors $F_{111}$, $F_{112}$, $F_{113}$ are turned on as a voltage is inducted across a second coil of each of the transformers 112, 113, 114, and generate a short-circuit between the anode plate (i.e., the potential of $V_{AH}$) of the field emission display panel and the system ground potential end (i.e., the potential of $V_{SG}$). The first through third capacitors $C_{111}$, $C_{112}$ $C_{113}$ induce a fast current flow.

As described above, in a field emission display apparatus according to the present invention, generation or non-generation of an arc discharge is determined from the value of a current flowing between the negative terminal of an anode voltage and a common ground line. Accordingly, the determination is rapidly made because the fact that an anode current flows suddenly when an arc discharge is generated in a field emission display panel was used.

Thus, when an arc discharge is generated in the field emission display panel, an arc-current detection signal may be rapidly generated by an abnormal current detection unit, and an application of the anode voltage by a discharge circuit may be rapidly blocked.

A resistor is used to measure the value of the current flowing between the negative terminal of the anode voltage and the common ground line. Thus, an initial current caused by the arc discharge may be prevented.

Accordingly, the field emission display apparatus according to the present invention provides an effective protection circuit capable of coping with an arc discharge.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission display apparatus comprising:

a field emission display panel, the field emission display panel having a common ground line of a system ground potential, fluorescent cells, electron emitter sources and an anode plate, the anode plate being responsive to an anode voltage from a positive anode voltage terminal and a negative anode voltage terminal for emitting electrons from the electron emitter sources to the fluorescent cells; and a driving device coupled to the field emission display panel for driving the field emission display panel, the driving device including a power supply unit, the power supply unit comprising:

an abnormal current detection unit for generating an arc-current detection signal when current flowing between the negative anode voltage terminal and the common ground line is larger than an upper current limit; and a discharge circuit for generating a short circuit between the anode plate and the negative anode voltage terminal in response to the arc-current detection signal.

2. The field emission display apparatus of claim 1, wherein the abnormal current detection unit comprises:

a current monitoring resistor between the negative anode voltage terminal and the common ground line;

an amplification unit for amplifying a voltage dropped across the current monitoring resistor; and a comparator generating the arc-current detection signal when an output voltage of the amplification unit is higher than a reference voltage.

3. The field emission display apparatus of claim 1, wherein the discharge circuit comprises:

a silicon control rectifier turned on in response to the arc-current detection signal;

at least one transformer having a first coil through which a current flows and a second coil across which a voltage is induced as the silicon control rectifier is turned on; and at least one transistor turned on as the voltage is induced across the second coil to generate a short-circuit between the anode plate and the system ground potential.

4. The field emission display apparatus of claim 3, wherein in the discharge circuit, the at least one transitor comprises a plurality of field effect transistors coupled in series between the anode plate and the system ground potential, and a gate and a source of each of the field effect transistors are connected to both output ends of a respective one of a plurality of transformers.

5. The field emission display apparatus of claim 1, wherein the power supply unit further comprises:

an abnormal voltage detection unit comprising a voltage monitoring inductor between the positive anode voltage terminal and the anode plate, the abnormal voltage detection unit generating an arc-voltage detection signal when a difference between voltages at both ends of the voltage monitoring inductor is larger than an upper limit; and an OR logic circuit outputting an arc generation signal for operating the discharge circuit in response to the arc-current detection signal or in response to the arc-voltage detection signal.

6. The field emission display apparatus of claim 5, wherein the abnormal voltage detection unit further comprises:

a voltage detection unit for detecting a voltage of the positive anode voltage terminal and a voltage of the anode plate; and a comparator generating the arc-voltage detection signal when a difference between the voltage of the positive anode voltage terminal and the voltage of the anode plate is greater than the upper limit.

7. The field emission display apparatus of claim 6, wherein in the comparator of the abnormal voltage detection unit, as the voltage of the anode plate drops, the difference between the voltage of the positive anode voltage terminal and the voltage of the anode plate increases.

8. The field emission display apparatus of claim 1, wherein the field emission display panel further comprises:

data electrode lines electrically connected to the electron emitter sources; and scan electrode lines intersecting the data electrode lines.

9. The field emission display apparatus of claim 8, wherein the data electrode lines are cathode electrode lines.

10. The field emission display apparatus of claim 9, wherein the scan electrode lines are gate electrode lines having through-holes corresponding to respective electron emitter sources, the through-holes being formed in areas of the gate electrode lines overlapped by the cathode electrode lines.

11. The field emission display apparatus of claim 10, wherein the fluorescent cells face the through-holes of the gate electrode lines.

* * * * *

UNITED STATES PATENT AND TRADEMARK OFFICE

CERTIFICATE OF CORRECTION

PATENT NO. : 7,701,454 B2
APPLICATION NO. : 11/835987
DATED : April 20, 2010
INVENTOR(S) : Duck-Gu Cho et al.

It is certified that error appears in the above-identified patent and that said Letters Patent is hereby corrected as shown below:

In the Claims

Column 9, Claim 4, line 9 Delete "transitor" Insert -- transistor --

Signed and Sealed this
Sixteenth Day of August, 2011

David J. Kappos

David J. Kappos
*Director of the United States Patent and Trademark Office*